US010850183B2

(12) United States Patent
Yang

(10) Patent No.: US 10,850,183 B2
(45) Date of Patent: Dec. 1, 2020

(54) SLIDING CARPET ASSEMBLY AND SLIDING CARPET

(71) Applicant: Beijing Running River Outdoor Sports Clothing Limited Company, Beijing (CN)

(72) Inventor: Yonggang Yang, Beijing (CN)

(73) Assignee: BEIJING RUNNING RIVER OUTDOOR SPORTS CLOTHING LIMITED COMPANY, Beijing (CN)

( * ) Notice: Subject to any disclaimer, the term of this patent is extended or adjusted under 35 U.S.C. 154(b) by 0 days.

(21) Appl. No.: 16/751,483

(22) Filed: Jan. 24, 2020

(65) Prior Publication Data

US 2020/0155921 A1 May 21, 2020

Related U.S. Application Data

(63) Continuation-in-part of application No. PCT/CN2019/070484, filed on Jan. 4, 2019.

(30) Foreign Application Priority Data

Jan. 24, 2018 (CN) ..... 2018 1 0069547
Feb. 6, 2018 (CN) ..... 2018 1 0118116

(51) Int. Cl.
*A63C 19/04* (2006.01)
*A63B 5/11* (2006.01)

(52) U.S. Cl.
CPC ..... *A63C 19/04* (2013.01)

(58) Field of Classification Search
CPC ..... A63C 19/00; A63C 19/02; A63C 19/04; A63B 22/02145; A63B 23/0429; A63B 5/00; A63B 5/11; A63B 2009/006
(Continued)

(56) References Cited

U.S. PATENT DOCUMENTS 2,358,426 A * 9/1944 Tompson ..... B64F 1/36 244/114 R
3,983,585 A * 10/1976 Sidlinger ..... A63B 5/11 482/27

(Continued)

FOREIGN PATENT DOCUMENTS

CN 1160595 A 10/1997
CN 206444145 U 8/2017

(Continued)

OTHER PUBLICATIONS

International Search Report issued in connection with PCT Application No. PCT/CN2019/070484 dated Mar. 29, 2019.

*Primary Examiner* — Kien T Nguyen
(74) *Attorney, Agent, or Firm* — Steven M. Shape; Dennemeyer & Associates, LLC

(57) ABSTRACT

A sliding carpet assembly and a sliding carpet. The sliding carpet assembly comprises multiple roll shaft units. Each roll shaft unit comprises a roll shaft (310), and a fixing catch (210) in contact with and connected to one side of the roll shaft (310). The fixing catch (210) includes a supporting body. The supporting body is provided with a first through hole (213) and a second through hole (214). The axis of the first through hole (213) and the axis of the second through hole (214) are perpendicular to each other and do not intersect with each other. Moreover, the sliding carpet assembly further includes multiple connecting ropes (100). In a first direction, the connecting ropes (100) pass through the first through holes (213) to connect the multiple sequentially arranged roll shaft units in series. In a second direction perpendicular to the first direction, the connecting ropes (100) pass through the second through holes (214) to sequentially connect the multiple sequentially arranged fixing catches (210).

10 Claims, 7 Drawing Sheets

(58) Field of Classification Search
USPC ..... 472/90, 91; 482/27, 34
See application file for complete search history.

(56) References Cited

U.S. PATENT DOCUMENTS

| | | | | | |
|---|---|---|---|---|---|
| 4,475,843 | A | | 10/1984 | Wyler | |
| 5,984,837 | A | * | 11/1999 | Weaver ..... | A63B 5/11<br>135/116 |

FOREIGN PATENT DOCUMENTS

| | | | |
|---|---|---|---|
| CN | 108144290 | A | 6/2018 |
| CN | 208130461 | U | 11/2018 |
| DE | 102015205095 | A1 | 9/2016 |
| WO | 2013127396 | A2 | 9/2013 |

* cited by examiner

SLIDING CARPET ASSEMBLY AND SLIDING CARPET

CROSS-REFERENCE TO RELATED APPLICATIONS

This is a 35 U.S.C. 371 National Stage patent application of International Application No. PCT/CN2019/070484, filed Jan. 4, 2019, which claims priority to Chinese application 201810069547.5 filed Jan. 24, 2018 and Chinese application 201810118116.3 filed Feb. 6, 2018, each of which is hereby incorporated by reference in its entirety.

TECHNICAL FIELD

The present application relates to a sliding carpet assembly and a sliding carpet.

BACKGROUND

With the improvement of people's living standards, extreme sports receive more and more people's attention and favor, such as bag flying training in extreme sports, including approaching and sliding→jumping and flying→wing-over→precise falling back to a slideway→continuing sliding, especially in sports such as skateboarding, mountain biking, skiing, and off-road motorcycle racing, bag flying is the most common. Because this high-challenge motion arouses people's inner desire for flying, many people are attracted to try, but this action is very dangerous, especially the action of precise falling back to a slideway is very difficult, and people are often injured.

For sake of safety, people have tried several kinds of equipment to carry out "fall-back" training, such as mats, pools, sponge pools, or horizontal air bags, which solve the problem of safe landing, but cannot achieve the purposes of "precise falling back to a slideway" and "continuing sliding". The appearance of a slope air bag can achieve "precise falling back to a slideway", but cannot achieve the purpose of continuing sliding. Moreover, the friction of the surface of a dry air bag on the slope air bag and a human body, clothing and equipment is too large, and when a sportsman falls to the slope air bag, because of the large friction, the sportsman cannot continue sliding, and sometimes may fall due to inertia, causing injury.

In addition, a one-way slideway of moving heavy objects, a children's slide, or a ski trough also has the problem of injury caused by too large sliding friction between the surface of the slideway and the heavy objects or the human body.

SUMMARY

The objective of the present application is to solve the problem of injury caused by large sliding friction.

According to an aspect of the present application, a sliding carpet assembly is provided. The sliding carpet assembly may include multiple roll shaft units. Each roll shaft unit may include a roll shaft, and a fixing catch which is in contact with and connected to one side of the roll shaft. The fixing catch may include a supporting body. The supporting body may be provided with a first through hole and a second through hole. The axes of the first through hole and the second through hole may be perpendicular to each other and do not intersect with each other. Moreover, the sliding carpet assembly may further include multiple connecting ropes. In a first direction, the connecting ropes may pass through the first through holes to connect the multiple sequentially arranged roll shaft units in series. In a second direction perpendicular to the first direction, the connecting ropes may pass through the second through holes to sequentially connect the multiple sequentially arranged fixing catches.

In the present application, the multiple roll shaft units are connected in series, and then the roll shaft units connected in series are rejoined into a surface to constitute the sliding carpet assembly. When a human body or an object slides over the sliding carpet assembly, rolling friction occurs instead of sliding friction, and the friction is very small. When the human body flies down on the sliding carpet assembly during exercise, it will not produce a stuck impact, but the human body can slow down and continue sliding, and then slow down to stop. This avoids falling due to inertia because of sudden deceleration caused by excessive resistance, or injury to the surface of the human body or other objects due to excessive friction. Meanwhile, the roll shaft can only slide in a fixed direction, limiting the direction of movement and avoiding side-to-side sway. The sportsman can continue sliding through the surface of the sliding carpet, or transport the object through the sliding carpet assembly, which increases the safety.

Optionally, the above sliding carpet assembly may further include: a center shaft sleeved in the roll shaft. The center shaft is a circular tube that is sleeved in the roll shaft. When the roll shaft rotates, it can protect the connecting rope. Meanwhile, the roll shaft and the center shaft are sleeved with each other to further enhance the sliding and sealing properties of the sliding carpet assembly and prevent invasion of foreign matters. The center shaft also has the function of supporting the roll shaft, thereby avoiding the axial pressing of the roll shaft, ensuring that the roll shaft is not squeezed and stops rotating, and ensuring that the roll shaft can be freely rotated.

Optionally, in the above sliding carpet assembly, the first through hole may be further provided with a first connecting portion and a second connecting portion which extend outwards along an axial direction of the first through hole. A first end of the roll shaft may be in sleeved connection with the second connecting portion. A second end of the roll shaft may be in sleeved connection with the first connecting portion of the next adjacent fixing catch. The connecting portion is designed such that the center shaft, the fixing catch and the roll shaft are sleeved. When the sliding carpet assembly is deformed by an external force, the first connecting portion, the center shaft and the second connecting portion are on the same axis, and support the rotation of the roll shaft, so that the roll shaft will not be squeezed and can be rotated normally. Moreover, such a sleeved connection is tighter, preventing foreign matters from entering gaps of the sliding carpet assembly, so that the sliding is smoother.

Optionally, in the above sliding carpet assembly, the middle of the roll shaft may be a constant diameter cylindrical hole. Both ends of the constant diameter cylindrical hole may be connected with a tapered hole having an inner diameter gradually increasing. The first connecting portion of the first through hole is sleeved in the tapered hole in one end of the roll shaft. When the sliding carpet is deformed by an external force and partially collapses, the tapered hole is designed to ensure that the roll shaft can be still rotated.

Optionally, in the above sliding carpet assembly, the fixing catch may be in a block shape. An upper surface of the fixing catch may be arcuate. The fixing catch may also be a wedge-shaped block or a square block. The sliding carpet assembly is subjected to great pressure during the application process, and the block shape can increase the contact surface with the support surface, reduce the pressure, achieve a supporting function, increase pressure bearing, increase load bearing, and can provide the transportation of goods. The arc shape of the upper surface is to reduce the contact area of the surface. As the contact area is small, the friction of the surface is small, thus reducing the sliding friction, so that the sliding is smoother.

Optionally, in the above sliding carpet assembly, the connecting rope is a metal material. Preferably, a steel cable is used as the connecting rope. More preferably, the connecting rope may be a steel cable made of a 304# stainless steel material, which is of a multi-strand steel cable structure, and has the advantages of good flexibility, high strength and the like. The material of the roll shaft and the center shaft is polyoxymethylene plastic. The polyoxymethylene plastic has the advantages of corrosion resistance, water resistance, high mechanical strength, steel and self-lubrication, and prolongs the service life of the roll shaft.

Optionally, in the above sliding carpet assembly, an outer surface of the roll shaft may be provided with two annular grooves. The two annular grooves divide the outer surface of the roll shaft into three parts. The annular grooves increase the frictional force in the first direction, and define the second direction as the sliding direction, so that the human body or the object slides to the second direction perpendicular to the first direction.

Optionally, in the above sliding carpet assembly, both ends of the connecting rope in the first direction are sleeved with push springs. When the sliding carpet assembly is under pressure, deformation occurs, and the push springs are stretched or contracted by an external force to act as an elastic buffering function, so that the roll shafts are tightly closed.

According to another aspect of the present application, the present invention also provides a sliding carpet, which may include the sliding carpet assembly according to any one of the above, and may further include an elastic suspension assembly, where the elastic suspension assembly may be connected to the periphery of the sliding carpet assembly. The elastic suspension assembly is installed around the sliding carpet assembly to form a sliding carpet. The sliding carpet may be suspended over a fixing frame, and a suspension space of the sliding carpet is maintained to ensure a deformation space of the sliding carpet, thereby ensuring the safety. For example, the sliding carpet is suspended over a steel frame, so that it is convenient to use, the size of the sliding carpet can be selected according to the specific environment, the placement position can be freely determined, and it is convenient to use. The sliding carpet is in a suspended state, and there is enough space in the lower part of the carpet surface for buffering and shock absorption of the human body or object that flies into the sliding carpet.

Optionally, in the above sliding carpet, the elastic suspension assembly may include a first suspension assembly and a second suspension assembly. The first suspension assembly may be perpendicular to the second suspension assembly. The first suspension assembly may include a tension spring, a first connecting plate, a first clamping sleeve, and a push spring. The tension spring may include a first pull hook and a second pull hook, the first pull hook and the second pull hook being located at both ends of the tension spring. The first connecting plate may include a first hole and a second hole, the first pull hook may hook the first hole of the connecting plate, and the connecting rope may pass through the second hole. The first clamping sleeve may be located between the first connecting plate and the push spring. The second suspension assembly may include a second connecting plate and a second clamping sleeve. One end of the second clamping sleeve may be in contact with and connected to the second connecting plate, and the other end may be in contact with and connected to the outer side of the second through hole of the fixing catch. The second clamping sleeve may be sleeved at one end of the connecting rope perpendicular to the first direction. When the sliding carpet is under pressure, deformation occurs, and the push springs are stretched or contracted by an external force to act as a buffering function, so that the roll shafts are tightly closed. Such a tension spring connection makes the entire sliding carpet easy to install and disassemble, the connection is tight and firm, and the safety coefficient is high.

According to another aspect of the present application, the present invention also provides a sliding carpet, which may include the sliding carpet assembly according to any one of the above, and may further include a slide body, where an upper surface of the slide body may be a plane or a curved surface; and the sliding carpet assembly may be laid on the slide body to form a one-way slideway. In practical applications, the above sliding carpet is directly laid on the surface of the slideway, and the sliding carpet is closely attached to the surface of the slideway. The shape of the sliding carpet depends on the shape of the slideway, and can be used for a training ground, an amusement park slideway, or moving goods, etc. The sliding carpet is convenient to install, is reusable, does not consume electricity and water, and achieves energy saving and environmental protection.

Optionally, in the above sliding carpet, the upper surface of the slide body may be U-shaped. The U-shaped slideway is a common slideway for skiing, skateboarding, etc. The sliding carpet of the present application is laid on the upper surface of the U-shaped slideway. A rolling friction is formed on the surface of the sliding carpet when a person slides from the bottom of the U-shaped slideway to the top of the U-shaped slideway. The friction is reduced, making the sliding easier. The entire action is smooth, while the sliding direction of the sliding carpet is uniform, and there is no deviation from the slideway, which is safer.

The above and other objectives, advantages and features of the present application will become apparent to those skilled in the art according to the detailed descriptions below for specific embodiments of the present application with reference to the drawings.

BRIEF DESCRIPTION OF THE DRAWINGS

Some specific embodiments of the present application will be described in detail below by way of example and not limitation. The same reference numbers in the drawings identify the same or similar components or parts. Those skilled in the art should understand that the drawings are not necessarily drawn to scale. In the drawings.

DETAILED DESCRIPTION OF THE EMBODIMENTS

Figure 1:
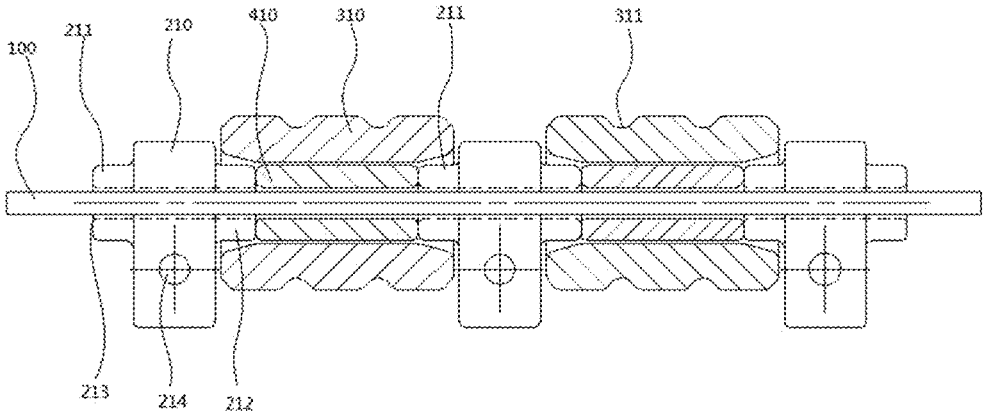
FIG. 1 is a schematic structural view of a sliding carpet assembly according to an embodiment of the present application.
Figure 9:
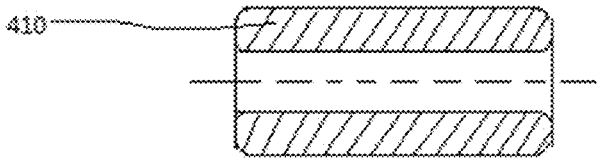
FIG. 9 is a cross-sectional view of a center shaft in a sliding carpet assembly according to an embodiment of the present application.
Figure 10:
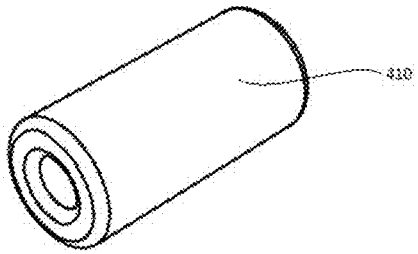
FIG. 10 is a three-dimensional schematic structural view of a center shaft shown in FIG. 9 in a sliding carpet assembly according to an embodiment of the present application.

FIG. 1 is a schematic structural view of a sliding carpet according to an embodiment of the present application. The sliding carpet of the present application includes multiple roll shaft units. Each roll shaft unit includes a roll shaft 310, and a fixing catch 210 which is in contact with and connected to one side of the roll shaft 310. The fixing catch 210 includes a supporting body. The supporting body is provided with a first through hole 213 and a second through hole 214. The axes of the first through hole 213 and the second through hole 214 are perpendicular to each other and do not intersect with each other. Moreover, the sliding carpet assembly further includes multiple connecting ropes 100. In a first direction, the connecting ropes 100 pass through the first through holes 213 to connect the multiple sequentially arranged roll shaft units in series. In a second direction perpendicular to the first direction, the connecting ropes pass through the second through holes 214 to sequentially connect the multiple sequentially arranged fixing catches 210. Thus, the multiple roll shaft units are connected in series, and then the roll shaft units connected in series are rejoined into a surface to constitute the sliding carpet assembly. When a person or a heavy object passes through the sliding carpet assembly, rolling friction occurs instead of sliding friction. The person can continue sliding thereon after exercise. This avoids falling due to inertia, impact injury caused by excessive resistance, or injury to the human body or other objects due to excessive friction. Meanwhile, the roll shaft 310 can only slide in a fixed direction, limiting the direction of movement and avoiding side-to-side sway. The sportsman can continue sliding through the surface of the sliding carpet, slow down and stop, and will not suddenly stop moving due to excessive friction. Or, when a moving object slides through the sliding carpet assembly, the direction of object movement is limited, which increases the safety. The center shaft 410 is sleeved in the roll shaft 310. The center shaft 410 is a circular tube that is sleeved in the roll shaft 310. The specific structure of the center shaft 410 refers to a cross-sectional view of a center shaft of FIG. 9 and a three-dimensional view of a center shaft of FIG. 10. When the roll shaft 310 rotates, the center shaft 410 can protect the connecting rope 100. Meanwhile, the roll shaft 310 and the center shaft 410 are sleeved with each other to further enhance the sealing properties of the sliding carpet assembly and prevent invasion of foreign matters. The center shaft 410 also has the function of supporting the roll shaft 310, thereby ensuring that the roll shaft 310 is not squeezed and stops rotating, and ensuring that the roll shaft 310 can be freely rotated.

Figure 2:
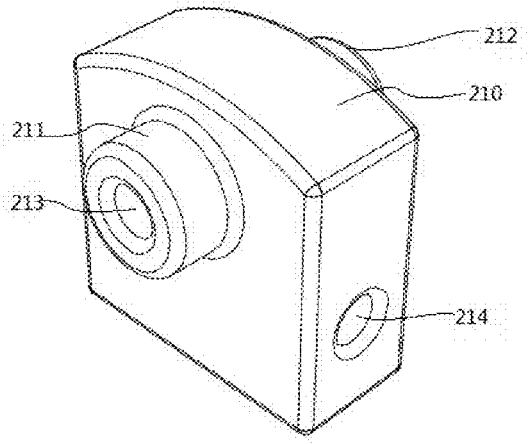
FIG. 2 is a three-dimensional schematic structural view of a fixing catch shown in FIG. 1 in a sliding carpet assembly according to an embodiment of the present application.
Figure 7:
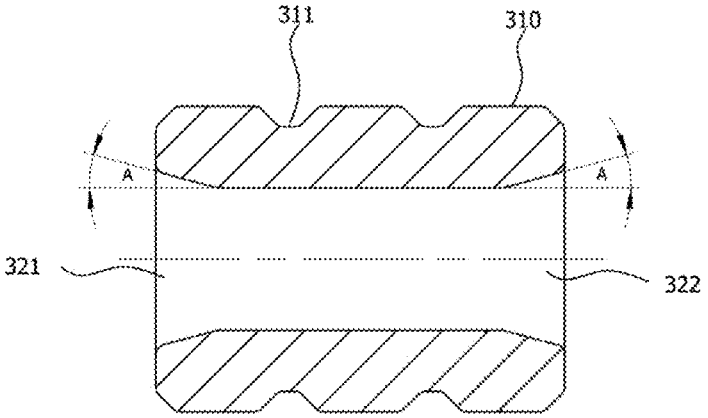
FIG. 7 is a cross-sectional view of a roll shaft in a sliding carpet assembly according to an embodiment of the present application.
Figure 8:
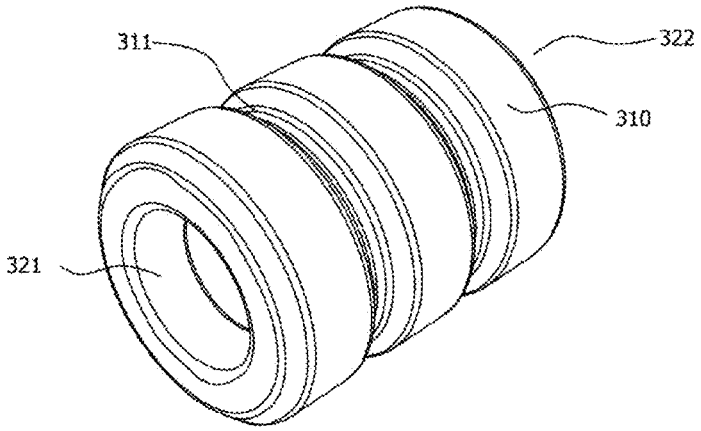
FIG. 8 is a three-dimensional schematic structural view of a roll shaft shown in FIG. 7 in a sliding carpet assembly according to an embodiment of the present application.

FIG. 2 is a three-dimensional view of the fixing catch 210 of the present application. In the above sliding carpet assembly, the first through hole 213 and the second through hole 214 are further provided with a first connecting portion 211 and a second connecting portion 212 which extend outwards along an axial direction of the first through hole. A first end 321 (as shown in FIGS. 7 and 8) of the roll shaft 310 is in sleeved connection with the second connecting portion 212. A second end 322 (as shown in FIGS. 7 and 8) of the roll shaft 310 is in sleeved connection with the first connecting portion 211 of the next adjacent fixing catch 210. The connecting portion is designed such that the fixing catch 210 and the roll shaft 310 body are sleeved. When the sliding carpet assembly is deformed by an external force, the first connecting portion 211, the center shaft 410 and the second connecting portion 212 are on the same straight line, and support the rotation of the roll shaft 310, so that the roll shaft 310 will not be squeezed and can be rotated normally. Moreover, such a sleeved connection is tight, preventing foreign matters from entering gaps of the sliding carpet assembly and protecting the sliding carpet assembly, so that the sliding is smoother.

Figure 3:
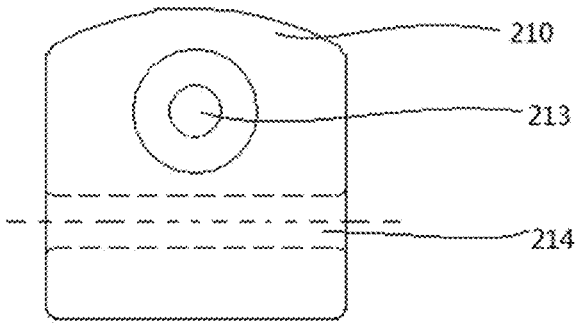
FIG. 3 is a side view of a fixing catch shown in FIG. 2 in a sliding carpet assembly according to an embodiment of the present application.
Figure 4:
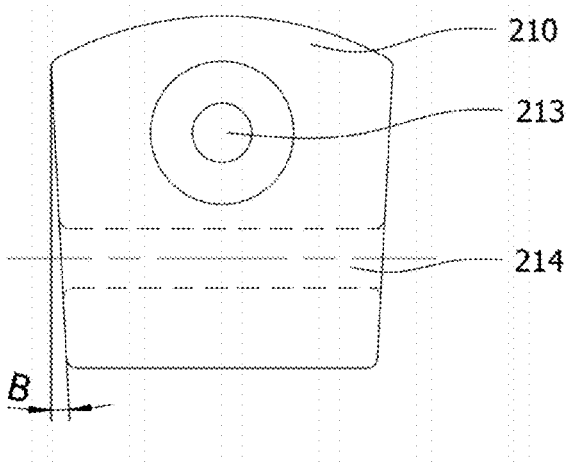
FIG. 4 is a side view of a fixing catch in a sliding carpet assembly according to an embodiment of the present application.
Figure 5:
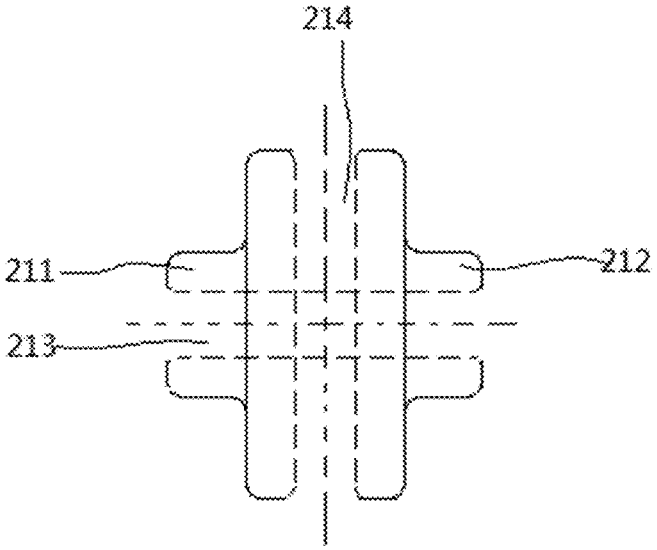
FIG. 5 is a top view of a fixing catch shown in FIG. 2 in a sliding carpet assembly according to an embodiment of the present application.
Figure 6:
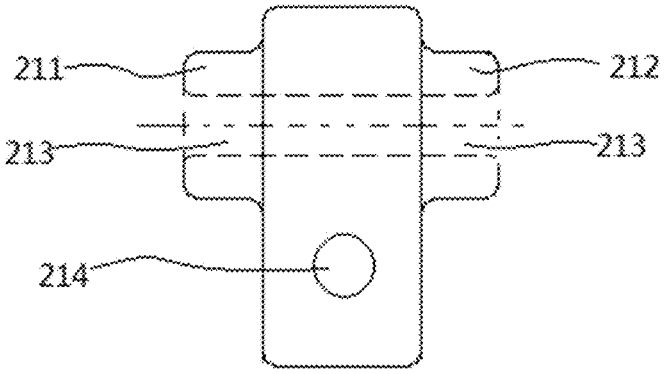
FIG. 6 is a front view of a fixing catch shown in FIG. 2 in a sliding carpet assembly according to an embodiment of the present application.

FIG. 3 is a side view of the fixing catch in FIG. 2. It can be seen from the figure that the fixing catch 210 is a block structure, the upper surface is arcuate, or the fixing catch 210 has a wedge-shaped end (as shown in FIG. 4), where the wedge has a wide upper part and a narrow lower part, and $\angle B$ is 3°. In other embodiments, the fixing catch may also be square, the sliding carpet assembly is subjected to great pressure during the application process, and the block shape can increase the contact surface with the support surface, reduce the pressure, achieve a supporting function, have stability, increase pressure bearing, increase load bearing, and can provide the movement of goods. One function of the fixing catch 210 is to define the position of the roll shaft 310 by defining the positions of the connecting ropes in the first direction and the second direction, so that the sliding carpet assembly is stabilized into a plane that can conform to the shape, and can be laid into a plane, a slope or a curved surface. The arc shape of the upper surface of the fixing catch 210 is to reduce the contact area of the surface. As the contact area is reduced, the friction of the surface is small, so that the sliding is smoother. To make the structure of the fixing catch 210 more convenient to those skilled in the art, FIG. 5 is a top view of the fixing catch 210, and FIG. 6 is a front view of the fixing catch 210.

FIG. 7 is a cross-sectional view of the roll shaft 310 of the sliding carpet assembly as shown in FIG. 1. The middle of the roll shaft 310 is a constant diameter cylindrical hole. Both ends of the constant diameter cylindrical hole are in communication with a tapered hole having an inner diameter gradually increasing. There is LA in the cross-sectional view of the tapered hole, and after repeated experiments, A is 15°. If being greater than this angle, a gap between the roll shaft 310 and the fixing catch 210 is too large, and it is prone to invaded by foreign matters, affecting the rotation of the roll shaft 310. If being smaller than this angle, the sliding carpet assembly is deformed by an external force, the roll shaft 310 and the fixing catch 210 are too tight, causing a jam and affecting the rotation. The annular grooves 311 surround the outer surface of the roll shaft 310. The two annular grooves 311 divide the outer surface of the roll shaft 310 into three regions. The annular grooves 311 increase the frictional force in the first direction, and define the second direction as the sliding direction, so that the human body or the object slides to the second direction perpendicular to the first direction. FIG. 8 is a three-dimensional view of the roll shaft 310, in which the structure of the annular groove 311 is clearer.

Figure 8B:
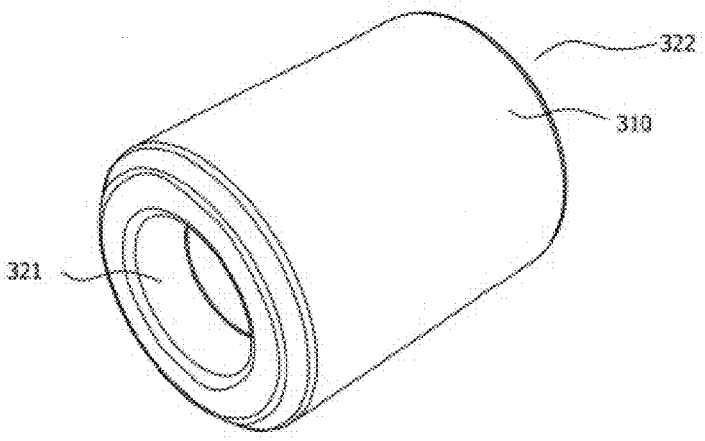
FIG. 8B is a three-dimensional schematic structural view of a roll shaft in a sliding carpet assembly according to an embodiment of the present application.

FIG. 8B is a schematic view of a roll shaft in one embodiment, where the roll shaft 310 is a hollow cylinder and the outer surface is a curved surface. Both ends of the cylinder are a first end 321 and a second end 32, respectively. The roll shaft 210 of the present embodiment may be applied to other embodiments.

Figure 11:
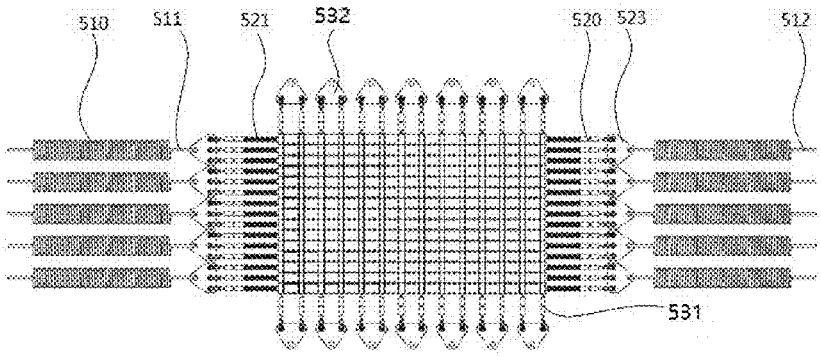
FIG. 11 is a schematic structural view of a sliding carpet according to an embodiment of the present application.
Figure 12:
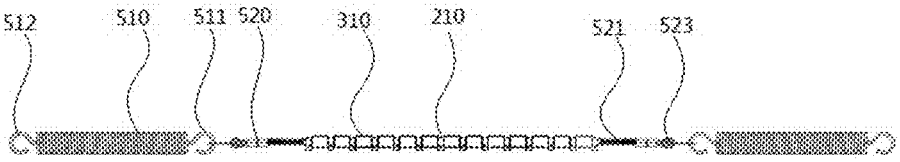
FIG. 12 is a side view of a sliding carpet shown in FIG. 11 in a sliding carpet according to an embodiment of the present application.

FIG. 11 is a schematic structural view of an embodiment of a gliding carpet in a specific embodiment. FIG. 12 is a side view of a sliding carpet according to an embodiment of the sliding carpet of the present application. The present application provides such a sliding carpet. The above sliding carpet assembly is suspended over a bracket by a spring suspension assembly or suspended according to the needs of the application. The spring suspension assembly includes a first suspension assembly and a second suspension assembly. The first suspension assembly is perpendicular to the second suspension assembly. The first suspension assembly includes a tension spring 510, a first connecting plate 523, a first clamping sleeve 520, and a push spring 521. The tension spring 510 includes a first pull hook 511 and a second pull hook 512, the first pull hook 511 and the second pull hook 512 being located at both ends of the tension spring 510. The first connecting plate 523 includes a first hole and a second hole, the first pull hook 511 hooks the first hole of the first connecting plate 523, and the connecting rope passes through the second hole to form a closed circle. The first clamping sleeve 520 is located between the connecting plate and the push spring. The first clamping sleeve 520 is sleeved at one end of the connecting rope in the first direction. The second suspension assembly includes a second connecting plate 532 and a second clamping sleeve 531. One end of the second clamping sleeve 531 is in contact with and connected to the second connecting plate 532, and the other end is in contact with and connected to the outer side of the second through hole 214 of the fixing catch 210. The second clamping sleeve 531 is sleeved at one end of the connecting rope perpendicular to the first direction. When the sliding carpet is deformed by an external force, deformation occurs, and the push springs 521 are stretched or contracted by an external force to act as a buffering function, so that the roll shafts 310 are tightly closed. The first clamping sleeve 520 realizes a tight connection between the connecting rope and the first connecting plate 523. The second clamping sleeve 531 realizes a tight connection between the connecting rope and the second connecting plate 532. The second pull hook can be hooked to a certain object or bracket as needed, thus increasing the application environment. The size and shape of the sliding carpet can be changed as required, which increases the practicality of the sliding carpet. Meanwhile, the sliding carpet does not need to consume electricity and water, thereby saving energy. A person does not need to pay attention to the sliding carpet for a long time, thereby saving manpower. If there is a problem with a roll shaft or other parts, only some of the components need to be replaced, thereby prolonging the life cycle and the service life. The positional relationship between the roll shaft 310 and the fixing catch 210 and the first suspension assembly of the sliding carpet in FIG. 12 is clearer.

Figure 13:
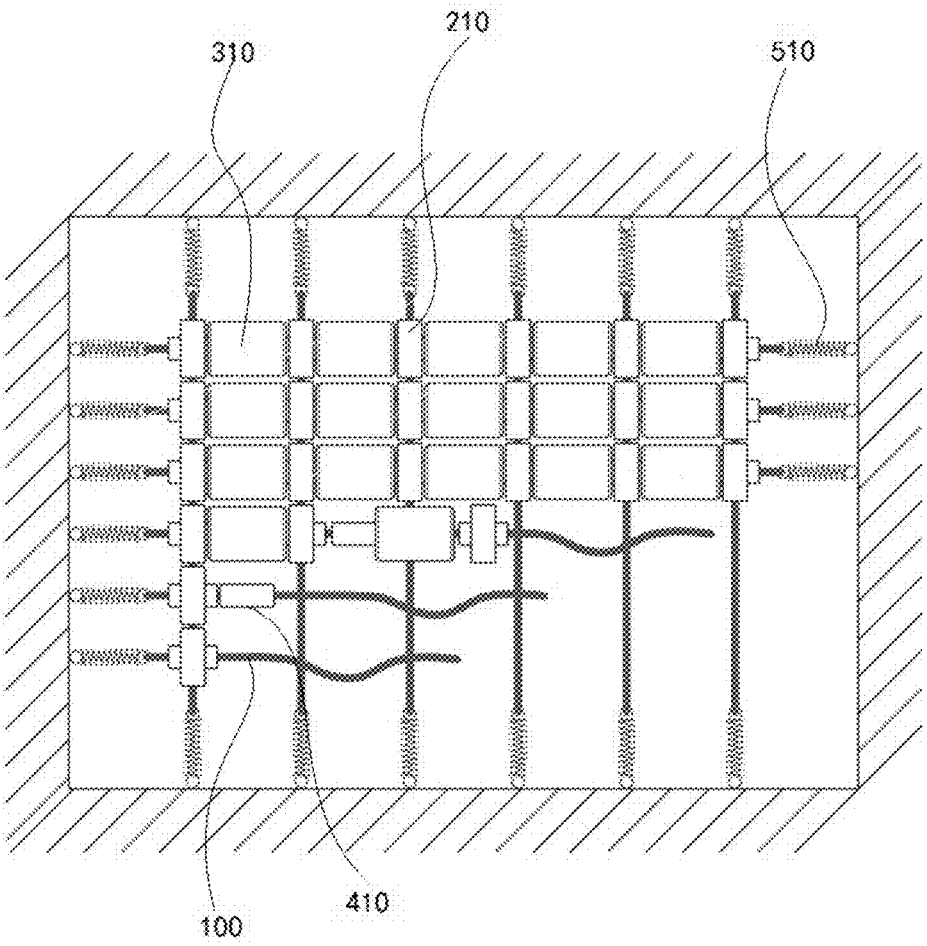
FIG. 13 is a schematic structural view of a sliding carpet according to an embodiment of the present application.

FIG. 13 shows a schematic structural view of a sliding carpet according to an embodiment of the present application. The elastic suspension assembly is composed of a tension spring 510. In the first direction, the connecting rope 100 passes through the first through hole 213 of the fixing catch 210 to connect the multiple sequentially arranged roll shaft units in series. In the second direction perpendicular to the first direction, the connecting rope passes through the second through hole 214 to sequentially connect the multiple sequentially arranged fixing catches 210. The roll shaft unit includes the roll shafts 310 and the fixing catches 210. Thus, the multiple roll shaft units are connected in series, and then the roll shaft units connected in series are rejoined into a surface to constitute the sliding carpet assembly. One end of the tension spring 510 is connected to the fixing catch 210 of the sliding carpet assembly, and the other end is connected to a fixing frame, where the fixing frame may be a frame or other fixtures prepared in advance. In this way, the sliding carpet can be fixed. When the sportsman falls on the sliding carpet, the sliding carpet can catch the sportsman and assist the sportsman to complete the action. Moreover, the rope 100 of the sliding carpet of the present application may be an elastic rope. When an athlete falls on the sliding carpet, the sliding carpet may be deformed after contacting the sliding carpet, and the elastic rope 100 may ensure that the sliding carpet can be deformed at the time of deformation.

Figure 14:
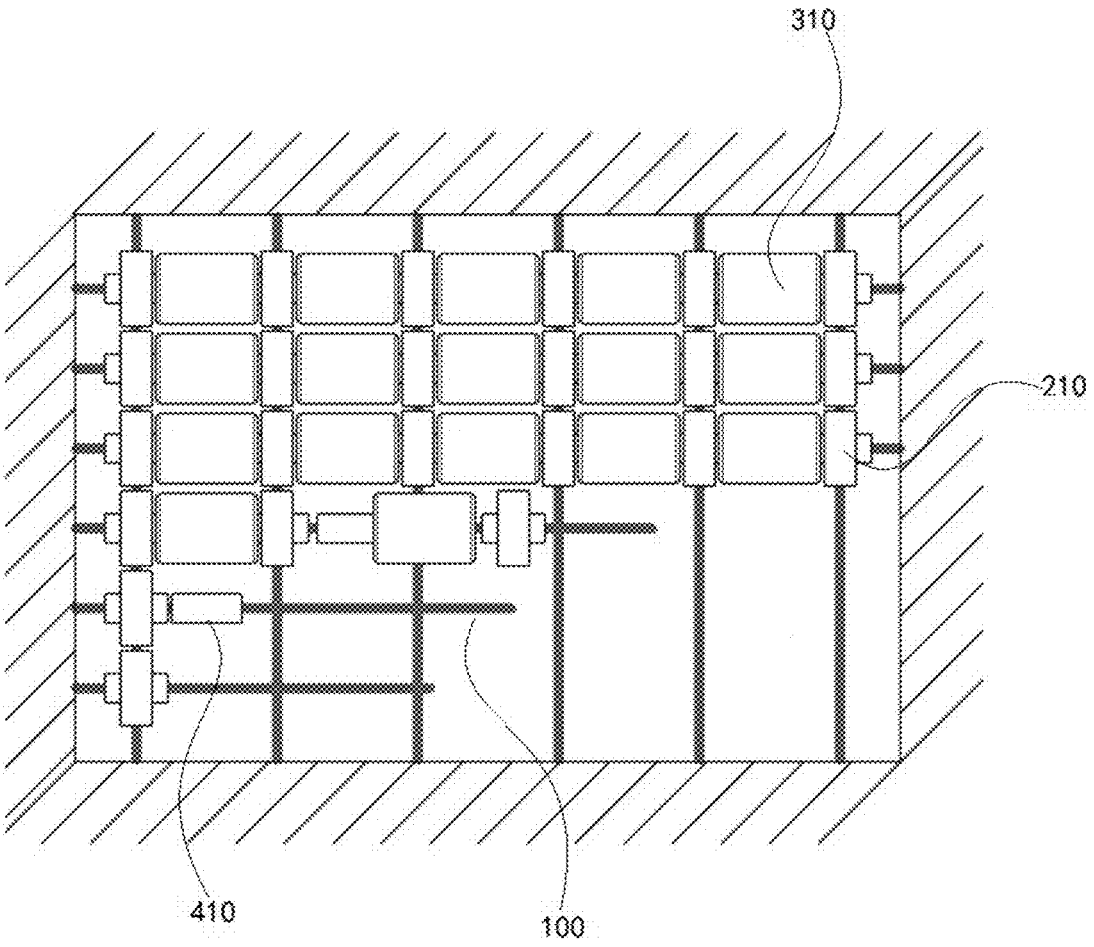
FIG. 14 is a schematic structural view of a sliding carpet according to an embodiment of the present application.

FIG. 14 shows a schematic structural view of a sliding carpet according to an embodiment of the present application. The sliding carpet assembly is directly fixed to a fixing frame or other fixtures for assisting in transporting heavy objects. In the present embodiment, the rope 100 is a rigid material that is not easily deformed. As a weight moves over the sliding carpet, the roll shaft 310 slides, reducing the force required to transport the weight. The rigid rope 100 keeps the sliding carpet flat and makes the weight easier to move. The manner of connecting the roll shaft 310 and the fixing catch 210 to the center shaft 410 is as described above, and will not be described herein.

In another specific embodiment, the present application provides a sliding carpet that uses the sliding carpet assembly of the present application. The sliding carpet is directly laid on an upper surface of a slide body, where the upper surface of the slide body is a plane or a curved surface. For example, the U-shaped slideway is a common slideway for skiing, skateboarding, etc. The sliding carpet of the present application is laid on the upper surface of the U-shaped slideway. A rolling friction is formed on the surface of the sliding carpet when a person slides from the bottom of the U-shaped slideway to the top of the U-shaped slideway. The friction is reduced, making the sliding easier. The entire action is smooth, while the sliding direction of the sliding carpet is uniform, and there is no deviation from the slideway, which is safer. The sliding carpet is directly laid on the surface of objects such as runways, floors, slides or slopes for sports training, entertainment or transporting heavy objects, etc. The sliding carpet produces rolling friction through objects or people on the surface, rather than sliding friction, making the movement smoother. If transporting goods, the resistance is reduced, and time and effort are saved. The sliding friction generates a large amount of heat, and the rolling friction of the sliding carpet generates less heat, which does not cause excessive friction and high temperature to injure the human body or cargoes. The sliding carpet is convenient to install and easy to manage, does not consume water and electricity, and achieves energy saving and environmental protection. Meanwhile, it can be laid according to the terrain and has strong practicability.

The above is only a preferred specific implementation manner of the present application, but the scope of protection of the present application is not limited thereto. Any person skilled in the art can easily think of changes or replacements within the technical scope disclosed in the present application, which should be covered by the scope of protection of the present application. Therefore, the scope of protection of the present application should be determined by the scope of the claims.

What is claimed is:

1. A sliding carpet assembly, comprising:

a plurality of roll shaft units, wherein each roll shaft unit comprises a roll shaft, and a fixing catch which is in contact with and connected to one side of the roll shaft;

the fixing catch comprises a supporting body, the supporting body is provided with a first through hole and a second through hole, and the axis of the first through hole and the axis of the second through hole are perpendicular to each other and do not intersect with each other;

and, the sliding carpet assembly further comprising: a plurality of connecting ropes;

in a first direction, the connecting ropes pass through the first through holes to connect the plurality of sequentially arranged roll shaft units in series; and in a second direction perpendicular to the first direction, the connecting ropes pass through the second through holes to sequentially connect the plurality of sequentially arranged fixing catches.

2. The sliding carpet assembly according to claim 1, further comprising:

a center shaft sleeved in the roll shaft.

3. The sliding carpet assembly according to claim 2, wherein the first through hole is further provided with a first and a second connecting portions which extend outwards along an axial direction of the first through hole;

a first end of the roll shaft is in sleeved connection with the second connecting portion; and a second end of the roll shaft is in sleeved connection with the first connecting portion of the next adjacent fixing catch.

4. The sliding carpet assembly according to claim 3, wherein the middle portion of the roll shaft is a constant diameter cylindrical hole; and either end of the constant diameter cylindrical hole is in communication with a tapered hole with a gradually increasing inner diameter, respectively.

5. The sliding carpet assembly according to claim 1, wherein the fixing catch is in a shape of a block; and an upper surface of the fixing catch is arcuate.

6. The sliding carpet assembly according to claim 1, wherein an outer surface of the roll shaft is provided with two annular grooves.

7. A sliding carpet, comprising the sliding carpet assembly according to claim 3, and further comprising:

an elastic suspension assembly, wherein the elastic suspension assembly is connected to the periphery of the sliding carpet assembly.

8. The sliding carpet according to claim 7, wherein the elastic suspension assembly comprises a first suspension assembly and a second suspension assembly;

the first suspension assembly is perpendicular to the second suspension assembly;

the first suspension assembly comprises a tension spring, a first connecting plate, a first clamping sleeve, and a push spring;

the tension spring comprises a first pull hook and a second pull hook located at both ends of the tension spring;

the first connecting plate comprises a first hole and a second hole, the first pull hook hooks the first hole of the connecting plate, and the connecting rope passes through the second hole;

the first clamping sleeve is located between the first connecting plate and the push spring;

the second suspension assembly comprises a second connecting plate and a second clamping sleeve; and one end of the second clamping sleeve is in contact with and connected to the second connecting plate, and the other end thereof is in contact with and connected to the outer side of the second through hole of the fixing catch.

9. A sliding carpet, comprising the sliding carpet assembly according to claim 1, and further comprising:

a slide body, wherein an upper surface of the slide body is a planar or a curved surface; and the sliding carpet assembly is laid on the slide body to form a one-way slideway.

10. The sliding carpet according to claim 9, wherein the upper surface of the slide body is U-shaped.

* * * * *